US009644476B2

(12) United States Patent
Lovell

(10) Patent No.: US 9,644,476 B2
(45) Date of Patent: May 9, 2017

(54) STRUCTURES HAVING CAVITIES CONTAINING COUPLER PORTIONS

(75) Inventor: John R. Lovell, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 528 days.

(21) Appl. No.: 13/356,035

(22) Filed: Jan. 23, 2012

(65) Prior Publication Data

US 2013/0186641 A1 Jul. 25, 2013

(51) Int. Cl.

| | |
|---|---|
| ***E21B 47/13*** | (2012.01) |
| ***E21B 47/12*** | (2012.01) |
| ***E21B 17/02*** | (2006.01) |

(52) U.S. Cl.

CPC ..... *E21B 47/122* (2013.01); *E21B 17/028* (2013.01)

(58) Field of Classification Search

CPC ..... E21B 17/028; E21B 17/023; E21B 47/09
USPC ..... 166/255.1, 378, 380, 382, 66, 242.6, 166/242.2; 175/40; 307/104; 340/854.6, 340/854.8

See application file for complete search history.

(56) References Cited

U.S. PATENT DOCUMENTS

| | | | |
|---|---|---|---|
| 2,214,064 | A | 9/1940 | Niles |
| 2,379,800 | A | 7/1945 | Hare |
| 2,452,920 | A | 11/1948 | Gilbert |
| 2,470,303 | A | 5/1949 | Greenough |
| 2,782,365 | A | 2/1957 | Castel |
| 2,797,893 | A | 7/1957 | McCune et al. |
| 2,889,880 | A | 6/1959 | Hughes |
| 3,011,342 | A | 12/1961 | Simm |
| 3,199,592 | A | 8/1965 | Jacob |
| 3,206,537 | A | 9/1965 | Steward |
| 3,344,860 | A | 10/1967 | Voetter |
| 3,363,692 | A | 1/1968 | Bishop |
| 3,659,259 | A | 4/1972 | Chaney, Jr. et al. |
| 3,913,398 | A | 10/1975 | Curtis |
| 4,027,286 | A | 5/1977 | Marosko |
| 4,133,384 | A | 1/1979 | Allen et al. |
| 4,241,787 | A | 12/1980 | Price |
| 4,415,205 | A | 11/1983 | Rehm et al. |
| 4,484,628 | A | 11/1984 | Lammon, II |

(Continued)

FOREIGN PATENT DOCUMENTS

| | | | |
|---|---|---|---|
| EP | 795679 | A2 | 9/1997 |
| EP | 823534 | A1 | 2/1998 |

(Continued)

OTHER PUBLICATIONS

Brown, G.A., SPE 62952. "Using Fibre-Optic Distributed Temperature Measurements to Provide Real-Time Reservoir Surveillance Data on Wytch Farm Field Horizontal Extended-Reach Wells" Society of Petroleum Engineers Inc. 2000, pp. 1-11.

(Continued)

*Primary Examiner* — Jennifer H Gay
*Assistant Examiner* — Steven MacDonald
(74) *Attorney, Agent, or Firm* — Michael Stonebrook

(57) ABSTRACT

An apparatus includes a first structure having a cavity containing a first coupler portion, and a first cover to sealably cover the cavity. In addition, a second structure for engaging the first inductive structure has a cavity containing a second coupler portion. A second cover is sealably covers the cavity of the second structure.

12 Claims, 4 Drawing Sheets

(56) References Cited

U.S. PATENT DOCUMENTS 4,536,714 A 8/1985 Clark
4,559,818 A 12/1985 Tsang et al.
4,573,541 A 3/1986 Josse et al.
4,597,290 A 7/1986 Bourdet et al.
4,733,729 A 3/1988 Copeland
4,806,928 A 2/1989 Veneruso
4,850,430 A 7/1989 Copeland et al.
4,901,069 A 2/1990 Veneruso
4,945,995 A 8/1990 Tholance et al.
4,953,636 A 9/1990 Mohn
4,969,523 A 11/1990 Martin et al.
5,183,110 A 2/1993 Logan et al.
5,269,377 A 12/1993 Martin
5,278,550 A 1/1994 Rhein-Knudsen et al.
5,301,760 A 4/1994 Graham
5,311,936 A 5/1994 McNair et al.
5,318,121 A 6/1994 Brockman et al.
5,318,122 A 6/1994 Murray et al.
5,322,127 A 6/1994 McNair et al.
5,325,924 A 7/1994 Bangert et al.
5,330,007 A 7/1994 Collins et al.
5,337,808 A 8/1994 Graham
5,353,876 A 10/1994 Curington et al.
5,388,648 A 2/1995 Jordan, Jr.
5,398,754 A 3/1995 Dinhoble
5,411,082 A 5/1995 Kennedy
5,427,177 A 6/1995 Jordan, Jr. et al.
5,435,392 A 7/1995 Kennedy
5,439,051 A 8/1995 Kennedy et al.
5,454,430 A 10/1995 Kennedy et al.
5,457,988 A 10/1995 Delatorre
5,458,199 A 10/1995 Collins et al.
5,458,209 A 10/1995 Hayes et al.
5,462,120 A 10/1995 Gondouin
5,472,048 A 12/1995 Kennedy et al.
5,474,131 A 12/1995 Jordan, Jr. et al.
5,477,923 A 12/1995 Jordan, Jr. et al.
5,477,925 A 12/1995 Trahan et al.
5,499,680 A 3/1996 Walter et al.
5,520,252 A 5/1996 McNair
5,521,592 A 5/1996 Veneruso
5,533,573 A 7/1996 Jordan, Jr. et al.
5,542,472 A 8/1996 Pringle et al.
5,597,042 A 1/1997 Tubel et al.
5,655,602 A 8/1997 Collins
5,680,901 A 10/1997 Gardes
5,697,445 A 12/1997 Graham
5,706,896 A 1/1998 Tubel et al.
5,730,219 A 3/1998 Tubel et al.
5,823,263 A 10/1998 Morris et al.
5,831,156 A 11/1998 Mullins
5,871,047 A 2/1999 Spath et al.
5,871,052 A 2/1999 Benson et al.
5,875,847 A 3/1999 Forsyth
5,915,474 A 6/1999 Buytaert et al.
5,918,669 A 7/1999 Morris et al.
5,941,307 A 8/1999 Tubel
5,941,308 A 8/1999 Malone et al.
5,944,107 A 8/1999 Ohmer
5,944,108 A 8/1999 Baugh et al.
5,944,109 A 8/1999 Longbottom
5,945,923 A 8/1999 Soulier
5,954,134 A 9/1999 Longbottom
5,959,547 A 9/1999 Tubel et al.
5,960,873 A 10/1999 Alexander et al.
5,967,816 A 10/1999 Sampa et al.
5,971,072 A 10/1999 Huber et al.
5,975,204 A 11/1999 Tubel et al.
5,979,559 A 11/1999 Kennedy
5,992,519 A 11/1999 Ramakrishnan et al.
6,003,606 A 12/1999 Moore et al.
6,006,832 A 12/1999 Tubel et al.
6,035,937 A 3/2000 Gano et al.
6,046,685 A 4/2000 Tubel
6,061,000 A 5/2000 Edwards
6,065,209 A 5/2000 Gondouin
6,065,543 A 5/2000 Gano et al.
6,073,697 A 6/2000 Parlin et al.
6,076,046 A 6/2000 Vasudevan et al.
6,079,488 A 6/2000 Begg et al.
6,079,494 A 6/2000 Longbottom et al.
6,119,780 A 9/2000 Christmas
6,125,937 A 10/2000 Longbottom et al.
6,173,772 B1 1/2001 Vaynshteyn
6,173,788 B1 1/2001 Lembcke et al.
6,176,308 B1 1/2001 Pearson
6,176,312 B1 1/2001 Tubel et al.
6,192,980 B1 2/2001 Tubel et al.
6,192,988 B1 2/2001 Tubel
6,196,312 B1 3/2001 Collins et al.
6,209,648 B1 4/2001 Ohmer et al.
6,244,337 B1 6/2001 Cumming et al.
6,302,203 B1 10/2001 Rayssiguier et al.
6,305,469 B1 10/2001 Coenen et al.
6,310,559 B1 10/2001 Laborde et al.
6,318,469 B1 11/2001 Patel
6,328,111 B1 12/2001 Bearden et al.
6,349,770 B1 2/2002 Brooks et al.
6,354,378 B1 3/2002 Patel
6,360,820 B1 3/2002 Laborde et al.
6,374,913 B1 4/2002 Robbins et al.
6,378,610 B2 4/2002 Rayssiguier et al.
6,415,864 B1 7/2002 Ramakrishnan et al.
6,419,022 B1 7/2002 Jernigan et al.
6,457,522 B1 10/2002 Bangash et al.
6,481,494 B1 11/2002 Dusterhoft et al.
6,510,899 B1 1/2003 Sheiretov et al.
6,513,599 B1 2/2003 Bixenman et al.
6,515,592 B1 2/2003 Babour et al.
6,533,039 B2 3/2003 Rivas et al.
6,568,469 B2 5/2003 Ohmer et al.
6,577,244 B1 6/2003 Clark et al.
6,588,507 B2 7/2003 Dusterhoft et al.
6,614,229 B1 9/2003 Clark et al.
6,614,716 B2 9/2003 Plona et al.
6,618,677 B1 9/2003 Brown
6,668,922 B2 12/2003 Ziauddin et al.
6,675,892 B2 1/2004 Kuchuk et al.
6,679,324 B2 1/2004 Den Boer et al.
6,695,052 B2 2/2004 Branstetter et al.
6,702,015 B2 3/2004 Fielder, III et al.
6,727,827 B1 4/2004 Edwards et al.
6,749,022 B1 6/2004 Fredd
6,751,556 B2 6/2004 Schroeder et al.
6,758,271 B1 7/2004 Smith
6,768,700 B2 7/2004 Veneruso et al.
6,776,256 B2 8/2004 Kostyuchenko et al.
6,787,758 B2 9/2004 Tubel et al.
6,789,621 B2 9/2004 Wetzel et al.
6,789,937 B2 9/2004 Haddad et al.
6,817,410 B2 11/2004 Wetzel et al.
6,828,547 B2 12/2004 Tubel et al.
6,837,310 B2 1/2005 Martin
6,842,700 B2 1/2005 Poe
6,845,819 B2 1/2005 Barrett et al.
6,848,510 B2 2/2005 Bixenman et al.
6,856,255 B2 2/2005 Chalitsios et al.
6,857,475 B2 2/2005 Johnson
6,863,127 B2 3/2005 Clark et al.
6,863,129 B2 3/2005 Ohmer et al.
6,864,801 B2 3/2005 Tabanou et al.
6,866,306 B2 3/2005 Boyle et al.
6,896,074 B2 5/2005 Cook et al.
6,903,660 B2 6/2005 Clark et al.
6,911,418 B2 6/2005 Frenier
6,913,083 B2 7/2005 Smith
6,920,395 B2 7/2005 Brown
6,942,033 B2 9/2005 Brooks et al.
6,950,034 B2 9/2005 Pacault et al.
6,975,243 B2 12/2005 Clark et al.
6,978,833 B2 12/2005 Salamitou et al.
6,980,940 B1 12/2005 Gurpinar et al.
6,983,796 B2 1/2006 Bayne et al.
6,989,764 B2 1/2006 Thomeer et al.

(56) References Cited

U.S. PATENT DOCUMENTS

| | | | | |
|---|---|---|---|---|
| 7,000,696 | B2 | 2/2006 | Harkins | |
| 7,000,697 | B2 | 2/2006 | Goode et al. | |
| 7,007,756 | B2 | 3/2006 | Lerche et al. | |
| 7,040,402 | B2 | 5/2006 | Vercaemer | |
| 7,040,415 | B2 | 5/2006 | Boyle et al. | |
| 7,055,604 | B2 | 6/2006 | Jee et al. | |
| 7,063,143 | B2 | 6/2006 | Tilton et al. | |
| 7,079,952 | B2 | 7/2006 | Thomas et al. | |
| 7,083,452 | B2 | 8/2006 | Eriksson et al. | |
| 7,093,661 | B2 | 8/2006 | Olsen | |
| 2001/0013410 | A1 | 8/2001 | Beck et al. | |
| 2002/0007948 | A1 | 1/2002 | Bayne et al. | |
| 2002/0050361 | A1 | 5/2002 | Shaw et al. | |
| 2002/0096333 | A1 | 7/2002 | Johnson et al. | |
| 2002/0112857 | A1 | 8/2002 | Ohmer et al. | |
| 2002/0114216 | A1* | 8/2002 | Veneruso et al. | 367/83 |
| 2003/0056984 | A1* | 3/2003 | Smith et al. | 175/40 |
| 2003/0137302 | A1 | 7/2003 | Clark et al. | |
| 2003/0137429 | A1 | 7/2003 | Clark et al. | |
| 2003/0141872 | A1 | 7/2003 | Clark et al. | |
| 2003/0150622 | A1 | 8/2003 | Patel et al. | |
| 2003/0221829 | A1 | 12/2003 | Patel et al. | |
| 2004/0010374 | A1 | 1/2004 | Raghuraman et al. | |
| 2004/0094303 | A1* | 5/2004 | Brockman et al. | 166/313 |
| 2004/0164838 | A1 | 8/2004 | Hall et al. | |
| 2004/0173350 | A1 | 9/2004 | Wetzel et al. | |
| 2004/0173352 | A1 | 9/2004 | Mullen et al. | |
| 2004/0194950 | A1 | 10/2004 | Restarick et al. | |
| 2004/0238168 | A1 | 12/2004 | Echols | |
| 2005/0072564 | A1 | 4/2005 | Grigsby et al. | |
| 2005/0074210 | A1 | 4/2005 | Grigsby et al. | |
| 2005/0083064 | A1 | 4/2005 | Homan et al. | |
| 2005/0087368 | A1 | 4/2005 | Boyle et al. | |
| 2005/0092488 | A1 | 5/2005 | Rodet et al. | |
| 2005/0092501 | A1 | 5/2005 | Chavers et al. | |
| 2005/0115741 | A1 | 6/2005 | Terry et al. | |
| 2005/0149264 | A1 | 7/2005 | Tarvin et al. | |
| 2005/0168349 | A1 | 8/2005 | Huang et al. | |
| 2005/0178554 | A1 | 8/2005 | Hromas et al. | |
| 2005/0194150 | A1 | 9/2005 | Ringgenberg | |
| 2005/0199401 | A1 | 9/2005 | Patel et al. | |
| 2005/0236161 | A1 | 10/2005 | Gay et al. | |
| 2005/0274513 | A1 | 12/2005 | Schultz et al. | |
| 2005/0279510 | A1 | 12/2005 | Patel et al. | |
| 2006/0000604 | A1 | 1/2006 | Jenkins et al. | |
| 2006/0000618 | A1 | 1/2006 | Cho et al. | |
| 2006/0006656 | A1 | 1/2006 | Smedstad | |
| 2006/0016593 | A1 | 1/2006 | Gambier | |
| 2006/0042795 | A1 | 3/2006 | Richards | |
| 2006/0060352 | A1 | 3/2006 | Vidrine et al. | |
| 2006/0065444 | A1 | 3/2006 | Hall et al. | |
| 2006/0077757 | A1 | 4/2006 | Cox et al. | |
| 2006/0086498 | A1 | 4/2006 | Wetzel et al. | |
| 2006/0090892 | A1 | 5/2006 | Wetzel et al. | |
| 2006/0090893 | A1 | 5/2006 | Sheffield | |
| 2006/0124297 | A1 | 6/2006 | Ohmer | |
| 2006/0124318 | A1 | 6/2006 | Sheffield | |
| 2006/0162934 | A1 | 7/2006 | Shepler | |
| 2006/0196660 | A1 | 9/2006 | Patel | |
| 2006/0225926 | A1 | 10/2006 | Madhavan et al. | |
| 2006/0254767 | A1 | 11/2006 | Pabon et al. | |
| 2006/0283606 | A1 | 12/2006 | Partouche et al. | |
| 2007/0012436 | A1 | 1/2007 | Freyer | |
| 2007/0027245 | A1 | 2/2007 | Vaidya et al. | |
| 2007/0044964 | A1 | 3/2007 | Grigar et al. | |
| 2007/0059166 | A1 | 3/2007 | Sheth et al. | |
| 2007/0062710 | A1 | 3/2007 | Pelletier et al. | |
| 2007/0074872 | A1 | 4/2007 | Du et al. | |
| 2007/0107907 | A1 | 5/2007 | Smedstad et al. | |
| 2007/0110593 | A1 | 5/2007 | Sheth et al. | |
| 2007/0116560 | A1 | 5/2007 | Eslinger | |
| 2007/0142547 | A1 | 6/2007 | Vaidya et al. | |
| 2007/0144738 | A1 | 6/2007 | Sugiyama et al. | |
| 2007/0144746 | A1 | 6/2007 | Jonas | |
| 2007/0151724 | A1 | 7/2007 | Ohmer et al. | |
| 2007/0159351 | A1 | 7/2007 | Madhavan et al. | |
| 2007/0162235 | A1 | 7/2007 | Zhan et al. | |
| 2007/0165487 | A1 | 7/2007 | Nutt et al. | |
| 2007/0199696 | A1 | 8/2007 | Walford | |
| 2007/0213963 | A1 | 9/2007 | Jalali et al. | |
| 2007/0216415 | A1 | 9/2007 | Clark et al. | |
| 2007/0227727 | A1 | 10/2007 | Patel et al. | |
| 2007/0235185 | A1 | 10/2007 | Patel et al. | |
| 2007/0271077 | A1 | 11/2007 | Kosmala et al. | |
| 2009/0212970 | A1* | 8/2009 | Hall et al. | 340/854.8 |

FOREIGN PATENT DOCUMENTS

| | | | |
|---|---|---|---|
| EP | 1158138 | A2 | 11/2001 |
| EP | 0786578 | B1 | 12/2005 |
| GB | 2274864 | A | 8/1994 |
| GB | 2304764 | A | 3/1997 |
| GB | 2333545 | A | 7/1999 |
| GB | 2337780 | A | 12/1999 |
| GB | 2345137 | A | 6/2000 |
| GB | 2360532 | A | 9/2001 |
| GB | 2364724 | A | 2/2002 |
| GB | 2376488 | A | 12/2002 |
| GB | 2381281 | A | 4/2003 |
| GB | 2392461 | A | 3/2004 |
| GB | 2395315 | A | 5/2004 |
| GB | 2395965 | A | 6/2004 |
| GB | 2401385 | A | 11/2004 |
| GB | 2401430 | A | 11/2004 |
| GB | 2401889 | A | 11/2004 |
| GB | 2404676 | A | 2/2005 |
| GB | 2407334 | A | 4/2005 |
| GB | 2408327 | A | 5/2005 |
| GB | 2409692 | A | 7/2005 |
| GB | 2416871 | A | 2/2006 |
| GB | 2419619 | A | 5/2006 |
| GB | 2419903 | A | 5/2006 |
| GB | 2426019 | A | 11/2006 |
| GB | 2428787 | A | 2/2007 |
| RU | 2136856 | C1 | 9/1999 |
| RU | 2146759 | C1 | 3/2000 |
| RU | 2171363 | C1 | 7/2001 |
| RU | 2239041 | C2 | 10/2004 |
| WO | 9623953 | A1 | 8/1996 |
| WO | 9850680 | A2 | 11/1998 |
| WO | 9850680 | A3 | 11/1998 |
| WO | 9858151 | A1 | 12/1998 |
| WO | 9913195 | A1 | 3/1999 |
| WO | 0029713 | A2 | 5/2000 |
| WO | 0171155 | A1 | 9/2001 |
| WO | 0198632 | A1 | 12/2001 |
| WO | 03023185 | A1 | 3/2003 |
| WO | 2004076815 | A1 | 9/2004 |
| WO | 2004094961 | A1 | 11/2004 |
| WO | 2005035943 | A1 | 4/2005 |
| WO | 2005064116 | A1 | 7/2005 |
| WO | 2006010875 | A1 | 2/2006 |

OTHER PUBLICATIONS

Saputelli, L. et al. "Real-Time Decision-making for Value Creation while Drilling" SPE/IADC Middle East Drilling Technology Conference & Exhibition, Oct. 2003.

Lanier et al. "Brunei Field Trial of a Fibre Optic Distributed Temperature Sensor (DTS) System in 1,DOOm Open Hole Horizontal Oil Producer" SPE 84324; SPE Annual Technical Conference and Exhibition, Oct. 5-8, 2003.

* cited by examiner

STRUCTURES HAVING CAVITIES CONTAINING COUPLER PORTIONS

BACKGROUND

A well can be drilled into a subterranean structure for the purpose of recovering fluids from a reservoir in the subterranean structure. Examples of fluids include hydrocarbons, fresh water, or other fluids. In another example, a well can be used for injecting fluids into the subterranean structure.

A well can be drilled using drilling equipment. Once the well is drilled, completion equipment can be installed in the well for managing the production and/or injection of fluids. Drilling equipment and completion equipment can include various components for performing respective tasks.

SUMMARY

In general, according to some implementations, an apparatus includes a first structure having a cavity containing a first coupler portion, and a first cover to sealably cover the cavity. In addition, a second structure for engaging the first inductive structure has a cavity containing a second coupler portion. A second cover is sealably covers the cavity of the second structure.

Other features will become apparent from the following description, from the drawings, and from the claims.

BRIEF DESCRIPTION OF THE DRAWINGS

Some embodiments are described with respect to the following figures.

DETAILED DESCRIPTION

Figure 1:
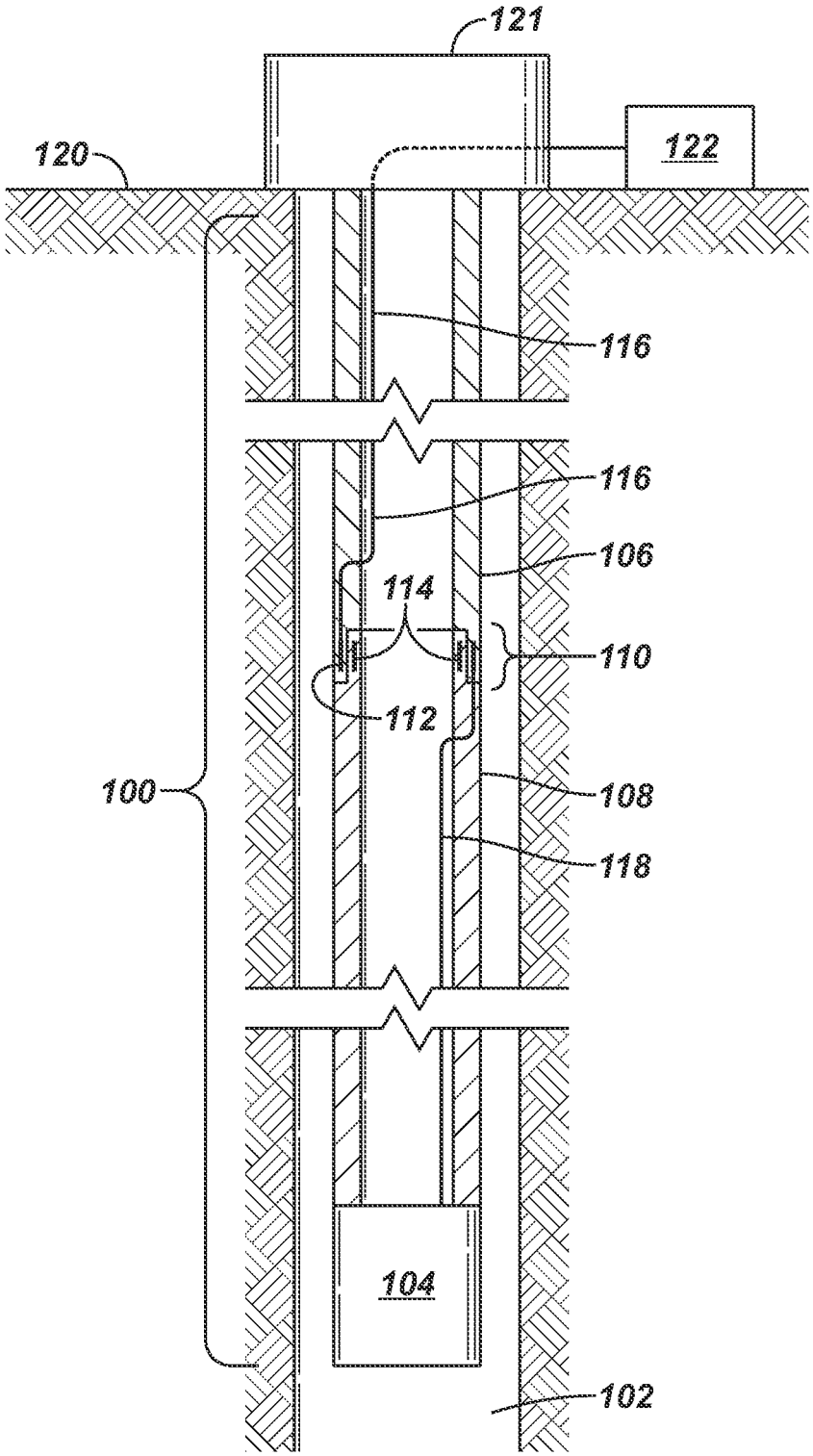
FIG. 1 illustrates an example arrangement including equipment in a well.

As used here, the terms "above" and "below"; "up" and "down"; "upper" and "lower"; "upwardly" and "downwardly"; and other like terms indicating relative positions above or below a given point or element are used in this description to more clearly describe some embodiments. However, when applied to equipment and methods for use in wells that are deviated or horizontal, such terms may refer to a left to right, right to left, or diagonal relationship as appropriate.

There are various different types of equipment that can be used to perform well operations. An example of such equipment includes a drill string for drilling a wellbore in an earth formation. As other examples, the equipment can include completion components such as flow control devices, sealing components, pumps, and so forth. A drill string or completion equipment can include electrical components that are to be electrically powered and/or that can perform data communications. In addition, other types of components can perform other types of communications, including optical communications and/or hydraulic communications. Optical communications can be performed to communicate data with optical signals, and hydraulic communications can be performed to hydraulically control a component.

Control lines can be used to perform respective different types of communications. As used here, "communications" can refer to communications of any one or more of: electrical data signals, electrical power signals, optical signals, and hydraulic pressure. In some examples, a control line can include an electrical cable having electrical wire(s) to communicate data and to provide electrical power to electrical components (e.g. a sensor, an electrically-activated device, etc.). In further examples, a control line can include an optical cable having optical fiber(s) for carrying optical signals to devices (e.g. a sensor, an optically-activated device, etc.) configured with an optical communications interface. In yet further examples, a control line can include a hydraulic control line to carry hydraulic fluid for communicating hydraulic pressure for controlling a hydraulic component (e.g. a packer, an anchor, etc.). In some examples, two or more different types of control lines (e.g. electrical cable, optical cable, hydraulic control line) can be present.

Presence of joints in equipment deployed in a well can present a challenge to performing communications using a control line with a downhole component. A "joint" refers to a portion of equipment where separate segments are attached together, such as by a threaded connection or by some other type of connection. In some cases, the separate segments can be connected together at a downhole location in the well. In other cases, the separate segments can be attached together at an earth surface location.

The presence of a joint results in a break in the continuity of an electrical circuit, optical path, or hydraulic path to a downhole component. Coupler portions can be provided at a joint to allow for communications at the joint between the segments of equipment connected by the joint. However, reliability issues can arise with the use of coupler portions at a joint. For example, the separate segments of the equipment may be disconnected and then connected repeatedly at a joint, which can lead to damage to coupler portions provided at the joint.

In accordance with some embodiments, protection mechanisms are provided for coupler portions that are located at a joint between segments of equipment to be deployed in a well. As discussed further below, in some implementations, the coupler portions are provided in cavities of the equipment segments, with the cavities provided with protective covers to protect against damage to the coupler portions due to connection of the equipment segments at the joint.

FIG. 1 illustrates an example arrangement that includes equipment 100 deployed in a well 102. In some examples, the equipment 102 has an electrical device 104. In further examples, additional components can be part of the equipment 100, such as components that can perform optical communications and/or components that are hydraulically controlled.

The equipment 100 has separate segments that are connected together at a joint 110. These segments include a first structure 106 and a second structure 108. In some examples, the structures 106 and 108 can be generally tubular structures, such as sections of a pipe or tubing. In other examples, the structures 106 and 108 can have other configurations.

The first and second structures 106 and 108 can be connected at the joint 110 using any of various attachment mechanisms, such as by a threaded connection or by some other type of connection. FIG. 1 shows just one joint—in other examples, a larger number of joints can be present.

In accordance with some embodiments, a first coupler portion 112 is provided in a cavity of the first structure 106, and a second coupler portion 114 is provided in a cavity of the second structure 108. When the first structure 106 and second structure 108 are attached together at the joint 110, the coupler portions 112 and 114 are brought into alignment such that communications can occur between the coupler portions 112 and 114. The couple portions 112 and 114 are brought into "alignment" when the coupler portions 112 and 114 are positioned in sufficient proximity to each other such that communications can occur between the coupler portions 112 and 114.

In some implementations, the coupler portions 112 and 114 include inductive coupler portions. An inductive coupler performs communication (data and/or power) using induction between the inductive coupler portions of the inductive coupler. Induction involves transfer of a time-changing electromagnetic signal or power that does not rely upon a closed electrical circuit, but instead performs the transfer wirelessly. For example, if a time-changing current is passed through a coil, then a consequence of the time variation is that an electromagnetic field will be generated in the medium surrounding the coil. If a second coil is placed into that electromagnetic field, then a voltage will be generated on that second coil, which is referred to as the induced voltage. The efficiency of this inductive coupling generally increases as the coils of the inductive coupler are placed closer together.

The inductive coupler portion 112 is electrically connected to an electrical cable 116, which can extend to an uphole component, such as a surface controller 122 provided at an earth surface 120 from which the well 102 extends. The electrical cable 116 can extend from the inductive coupler portion 112 through wellhead equipment 121 to the surface controller 122. As another example, the uphole component to which the electrical cable 116 extends can be a component (such as a downhole controller) located in the well 102 but above the inductive coupler portion 112.

The inductive coupler portion 114 in the second structure 108 is connected to an electrical cable 118, which extends to the electrical device 104. During operation, electrical communication (power and/or data) can be performed between the surface controller 122 and the electrical device 104 through the electrical cables 116 and 118 and the inductive coupler portions 112 and 114. Although the electrical cables 116 and 118 are depicted as running in the inner bores of the respective structures 106 and 108, respectively, it is noted that in other implementations, the electrical cables 116 and 118 can run outside of the respective structures 106 and 108, or the electrical cables 116 and 118 can be embedded within respective structures 106 and 108.

In other implementations, in addition to inductive coupler portions, other types of coupler portions can also be provided in the corresponding cavities, where such other types of coupler portions include elements to perform other types of communications, such as optical communications and/or hydraulic communications. For example, optical coupler portions can include optical lenses and other optical elements to allow for communication of optical signals between the optical coupler portions once they are brought into alignment due to connection of the first and second structures 106 and 108. In such implementations, in addition to electrical cables 116 and 118, optical cables can also be provided that run to the surface controller 122 and a downhole device, respectively.

In further examples, hydraulic coupler portions can also be provided, which can include hydraulic ports and hydraulic fluid passageways that are sealingly engaged to each other once the coupler portions are brought into alignment by connection of the first and second structures 106 and 108. In such examples, hydraulic control lines can also be connected to the hydraulic coupler portions to hydraulically communicate with the surface controller 122 and a downhole device, respectively.

In the ensuing discussion, it is assumed that the coupler portions 112 and 114 are inductive coupler portions. Note that techniques or mechanisms according to some embodiments can also be applied to coupler portions that further include other communications elements, including optical elements and/or hydraulic elements.

Over the life of the equipment 100, the first structure 106 and the second structure 108 can be repeatedly disconnected and connected at the joint 110. To protect the coupler portions 112 and 114 from damage due to such repeated disconnection and connection, protective covers can be provided (discussed further below). The protective covers can be formed of a relatively sturdy material, such as metal or other type of material that can provide protection against forces due to disconnection and connection of the structures 106 and 108.

Figure 2:
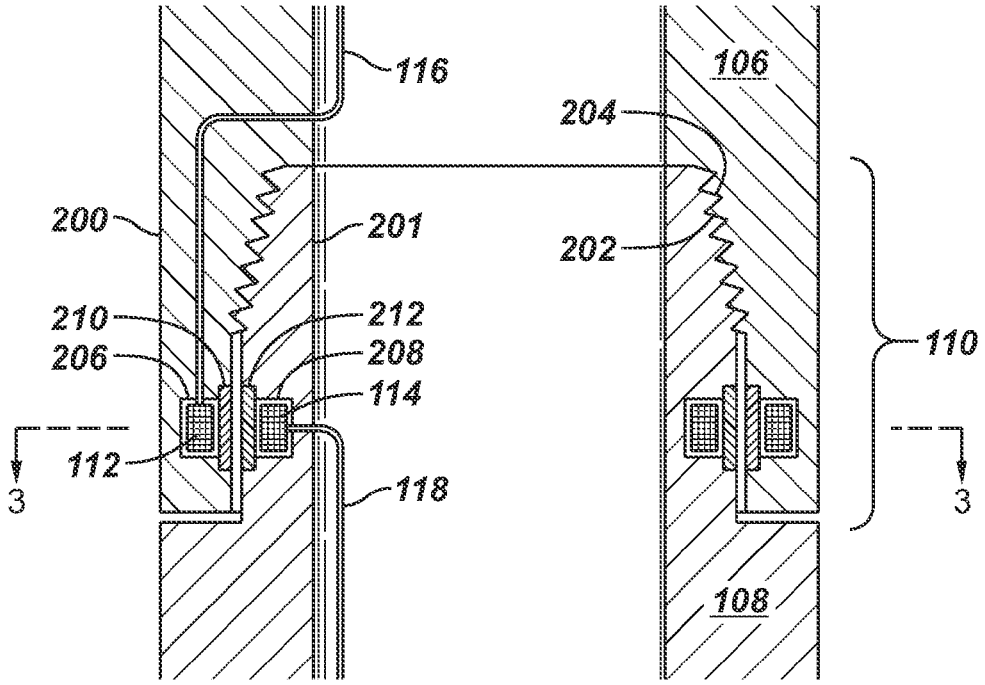
FIGS. 2 and 6 are longitudinal sectional views of segments of the equipment of FIG. 1, according to various embodiments.

FIG. 2 illustrates portions of the first and second structures 106 and 108 in greater detail. The first structure 106 has an engagement portion 200 for engaging a corresponding engagement portion 201 of the second structure 108. In implementations according to FIG. 2, the engagement portions 200 and 201 of the structures 106 and 108 include respective threads 202 and 204. The threads 202 and 204 allow for threaded connection of the first and second structures 106 and 108 when the first and second structures 106 and 108 are rotatably brought into engagement with each other. Note that small gaps are depicted in FIG. 2 between the engagement portions 200 and 201. These gaps are provided to show separation between the engagement portions 200 and 201, for better clarity. In practice, when the engagement portions 200 and 201 are engaged with each other, they are actually in contact with one another, as are the threads 202 and 204.

In other implementations, instead of a threaded connection at the joint 110, other connection mechanisms can be used, such as a connection mechanism in which the structures 106 and 108 are brought into sliding engagement.

Figure 3:
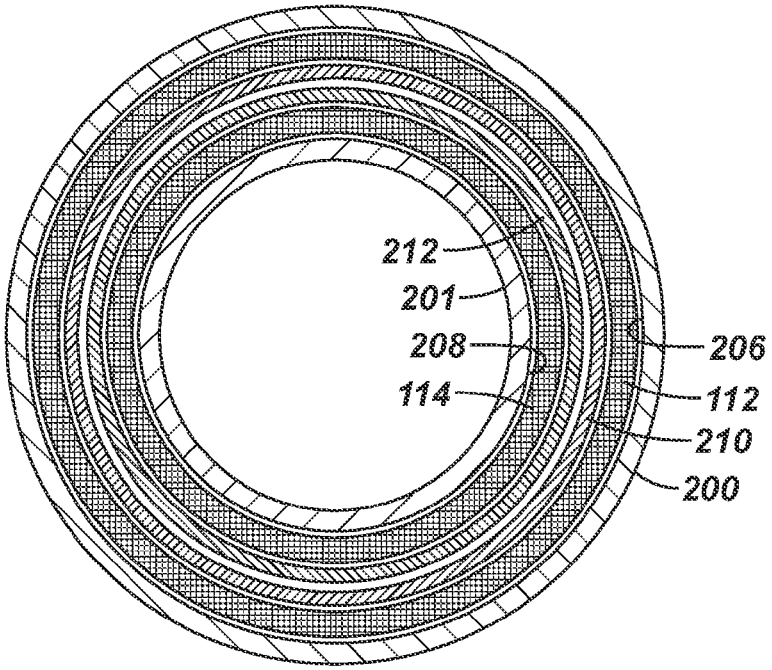
FIG. 3 is a cross-sectional view of a portion of the structure shown in FIG. 2.

In accordance with some embodiments, the engagement portion 200 of the first structure 106 also has a cavity 206. Note that the cavity 206 can be generally annular in shape and extends around a circumference of the engagement portion 200 (as shown in FIG. 3, which is a cross-sectional view of the structures 106 and 108 in FIG. 2 along section 3-3). The first inductive coupler portion 112, which can be generally ring-shaped (see FIG. 3), is contained in the cavity 206.

Similarly, the engagement portion 201 of the second structure 108 can have a generally annular cavity 208 (see FIG. 3) that contains the generally ring-shaped second inductive portion 114 (see FIG. 3).

A protective cover 210 is provided to sealably cover the cavity 206, while another protective cover 212 is provided to sealably cover the cavity 208. In some examples, the protective cover 210 can be welded to the wall of the engagement portion 200, while the protective cover 212 can be welded to the wall of the engagement portion 201. The welding allows each of protective cover 210 or 212 to form a hermetic seal the respective inductive coupler portion in the corresponding cavity. In other examples, the protective covers 210 and 212 can be attached to the engagement portions 200 and 201, respectively, using different attachment mechanisms. The protective covers 210 and 212 can be sleeves that can be generally ring-shaped (see FIG. 3).

As noted above, each of the protective covers 210 and 212 can be formed of a metal in some implementations. In other implementations, other types of materials can be employed for the covers 210 and 212—such materials can be electrically conductive.

Figure 4:
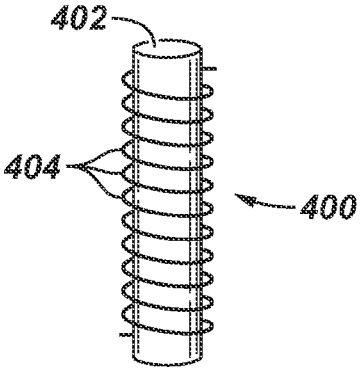
FIG. 4 illustrates a solenoid according to some examples.

In some examples, each of the inductive coupler portions 112 and 114 can be implemented as a solenoid. As shown in FIG. 4, a solenoid 400 includes a generally cylindrical rod 402 formed of an electrically conductive material on which an electrical wire 404 is wound in a spiral pattern.

Figure 5:
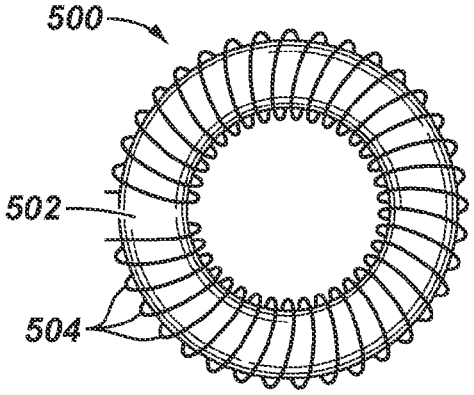
FIG. 5 illustrates a toroid according to some examples.

In other implementations, each of the inductive coupler portions 112 and 114 can include a toroid 500, such as shown in FIG. 5, which has a ring-shaped, electrically conductive structure 502 on which an electrical wire 504 is wound.

Passage of an electrical current through either the electrical wire 404 or 504 in the solenoid 400 or toroid 500, respectively, causes a magnetic field to be produced, which can be sensed by a corresponding solenoid or toroid placed in relatively close proximity to allow for inductive coupling.

In other implementations, other types of inductive couplers can be used.

Figure 6:
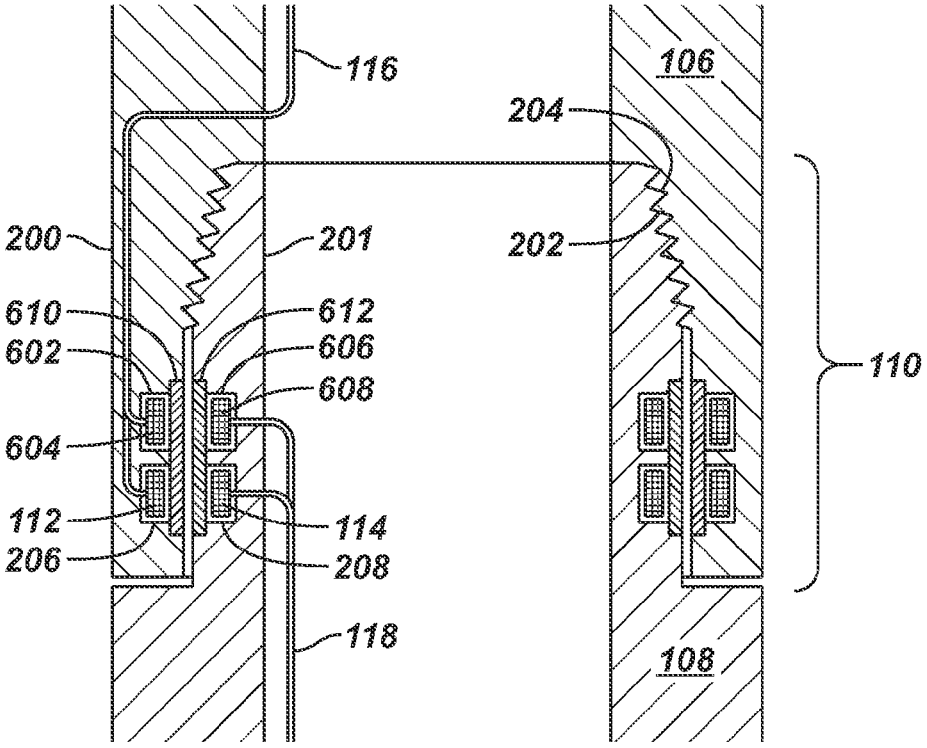

FIG. 6 illustrates portions of the first and second structures 106, 108, according to other implementations. Instead of providing just one cavity to receive the corresponding inductive coupler portion, each of the engagement portions 200 and 201 of the first and second structures 106 and 108 can include a pair of cavities to receive a pair of respective inductive coupler portions. Thus, as shown in FIG. 6, the engagement portion 200 of the first structure 106 has the cavity 206 as well as another cavity 602. The cavity 206 receives the inductive coupler portion 112, while the cavity 602 receives another inductive coupler portion 604.

Similarly, the engagement portion 201 of the second structure 108 includes the cavity 208 (for receiving the inductive coupler portion 114) and a second cavity 606 (for receiving another inductive coupler portion 608).

In FIG. 6, respective protective covers 610 and 612 are used to cover the respective pairs of cavities 206, 602, and 208, 606. In other examples, instead of using one protective cover to cover a pair of cavities in each engagement portion, separate protective covers can be used for covering respective individual cavities in other examples.

The presence of a pair of inductive coupler portions in each engagement portion allows for data communication and power communication to be performed using separate inductive coupler portions. Thus, for example, the inductive coupler portion 112 can be used to perform data communication with the corresponding inductive coupler portion 114, while the inductive coupler portion 604 can be used to perform power communication with the corresponding inductive coupler portion 608.

Separating the power and data communications allows for more reliable coupling between the inductive coupler portions. Power is made up of relatively low-frequency signal elements, while data is made up of relatively high-frequency signal elements.

To separate the power and data, various mechanisms can be employed. For example, a high-pass filter can be used to direct the high-frequency components to the inductive coupler portions 112 and 114, while a low-pass filter can be used to direct low-frequency components to the inductive coupler portions 604 and 608. In other examples, differential amplifiers or transformers can be used to sum and subtract signals on the pair of wires that make up each of the cables 116 and 118. Subtraction of the signal on one wire from the signal on another wire results in data, which can be provided to a respective one of the inductive coupler portions 112 and 114. In other implementations, other techniques or mechanisms for separating low-frequency and high-frequency components of analog or digital and signals can be used.

Figure 7:
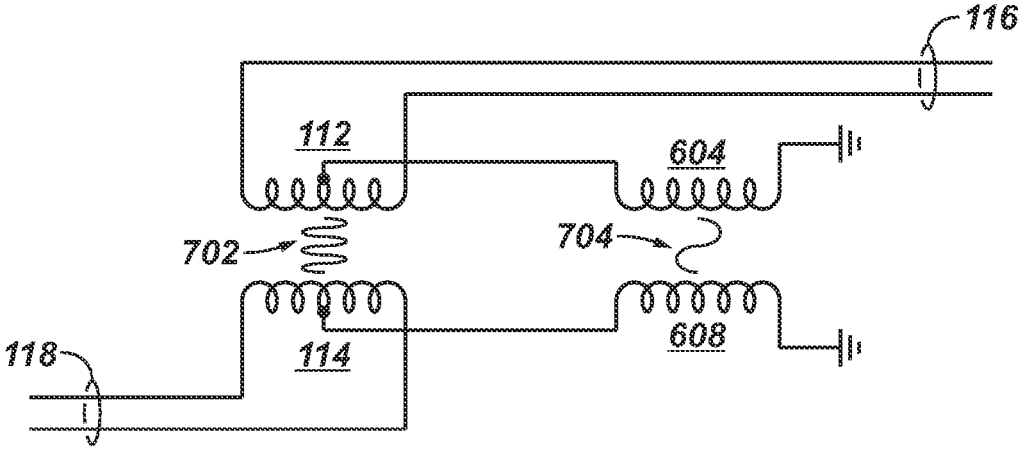
FIG. 7 is a circuit diagram of circuitry including inductive coupler portions according to some embodiments.

FIG. 7 depicts an example circuit to separate high-frequency signal and low-frequency power by transmitting the signal using balanced differential telemetry, where the signal along one wire of a cable (116 or 118) returns along the other wire of the cable. The circuit of FIG. 7 can also transmit power using a common-mode transmission wherein the power is transmitted simultaneously down the two wires of the cable with a return through earth or circuit ground. The two wires of the cable can be twisted inside a metal control line so that any exterior electromagnetic noise is added to the wire in common-mode, not differential mode. The exterior of the control line housing can be used as the earth return for common-mode power. In additional the completion itself can be used as the return. The transformer represented with coil 114 and coil 112 has center-taps on both the coils. This construction allows the differential signal to pass via induction as 702 between the coils, whereas the common-mode of the cable 116 will pass to the coil 604 of the power transformer, and from there to ground. The low-frequency power signal will pass via induction, 704, to the coil 608 of the power transformer, and from there into the center tap of the coil 114 where it adds as common-mode on the cable 118. The net result is that the pair of wires in the cable 118 carry the high-frequency signal in differential mode and low-frequency power signal in common mode.

Figure 8:
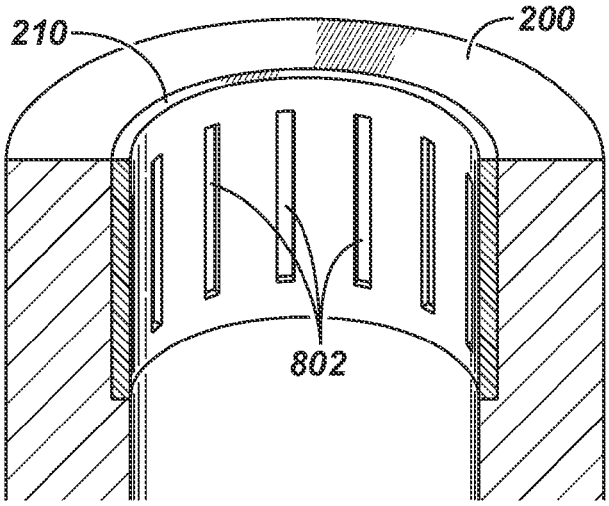
FIG. 8 illustrates portions of a protective cover and an engagement portion, according to some implementations.

As noted above, the protective covers (210, 212, 610, 612) can be formed of a material including metal. A metal is relatively sturdy and thus is able to provide relatively good protection for corresponding coupler portions. In other examples, the protective covers can be formed of a different material. In some cases, the metal protective cover (or cover formed of another material) can be electrically conductive, which can present an obstacle to inductive coupling between the inductive coupler portions. In accordance with some embodiments, as shown in FIG. 8, the protective cover 210 (which covers a cavity in the engagement portion 200 of the first structure 106 depicted in FIG. 2) can have thinned portions 802 in the wall of the protective cover 210. The thinned portions 802 of the protective cover wall includes a lesser thickness of electrically conductive material, which presents a lower barrier to inductive coupling. The other protective covers (212, 610, 612) discussed above can similarly be provided with thinned portions similar to 802.

By using techniques or mechanisms according to some implementations, more reliable communications using coupler portions can be provided, since protective covers are used to protect the coupler portions at a joint.

In the foregoing description, numerous details are set forth to provide an understanding of the subject disclosed herein. However, implementations may be practiced without some of these details. Other implementations may include modifications and variations from the details discussed above. It is intended that the appended claims cover such modifications and variations.

What is claimed is:

1. An apparatus comprising:

a first structure having a cavity containing a first inductive coupler portion and a third inductive coupler portion;

a first cover formed of an electrically conductive material to sealably cover the cavity of the first structure;

a second structure to engage the first structure, the second structure having a cavity containing a second inductive coupler portion and a fourth inductive coupler portion; and a second cover formed of an electrically conductive material to sealably cover the cavity of the second structure, wherein the first and second inductive coupler portions are configured to couple and the third and fourth inductive coupler portions are configured to couple, wherein the first cover comprises a first sleeve, and the second cover comprises a second sleeve.

2. The apparatus of claim 1, wherein the first and second covers are each formed of a material including metal.

3. The apparatus of claim 1, wherein the second structure is to threadably connect to the first structure.

4. The apparatus of claim 1, wherein each of the first and second structures are generally tubular in shape.

5. The apparatus of claim 1, wherein the inductive coupler portions of the first structure are to separately communicate power and data, and wherein the inductive coupler portions of the second structure are to separately communicate power and data.

6. The apparatus of claim 1, wherein each of the first and second covers includes a wall having thinned portions having a lesser thickness of the electrically conductive material than a remainder of the wall.

7. A system comprising:

a first structure having a cavity containing a first inductive coupler portion and a third inductive coupler portion;

a first electrical cable connected to the first inductive coupler portion;

a first cover comprising a first sleeve and formed of a material including metal to sealably cover the cavity of the first structure, wherein the first cover is large enough and positioned to cover both the first and third inductive coupler portions;

a second structure to engage the first structure, the second structure having a cavity containing a second inductive coupler portion configured to inductively couple with the first inductive coupler portion and a fourth inductive coupler portion configured to inductively couple with the third inductive coupler portion;

a second electrical cable connected to the second inductive coupler portion; and a second cover comprising a second sleeve and formed of a material including metal to sealably cover the cavity of the second structure, wherein the second cover is large enough and positioned to cover both the second and fourth inductive coupler portions.

8. The system of claim 7, wherein the first electrical cable is to extend to a controller uphole of the first inductive coupler portion, and wherein the second electrical cable is to extend to an electrical device downhole of the second inductive coupler portion.

9. The system of claim 7, wherein each of the first and second covers has a wall that includes thinned portions that have a reduced thickness of the material including metal.

10. The system of claim 7, wherein the inductive coupler portions of the first structure art to separately communicate power and data, and wherein the inductive coupler portions of the second structure are to separately communicate power and data.

11. The system of claim 7, wherein each of the first and second structures are generally tubular in shape.

12. A method comprising:

positioning a first structure in a well, wherein the first structure has a cavity containing a first inductive coupler portion and a third inductive coupler portion, and wherein a first protective cover formed of an electrically conductive material sealably covers the cavity and both the first and third inductive coupler portions;

connecting a second structure to the first trucks or at a joint, wherein the second structure has a cavity containing a second inductive coupler portion and a fourth inductive coupler portion, and wherein a second protective cover formed of an electrically conductive material sealably covers a cavity in the second structure and both the second and fourth inductive coupler portions; and aligning the first and second inductive coupler portions and the third and fourth inductive coupler portions upon connecting the first and second structures to allow the first and second inductive coupler portions and third and fourth inductive coupler portions to communicate with each other, wherein the first protective cover comprises a first sleeve and the second protective cover comprises a second sleeve.

* * * * *